US005531592A

United States Patent [19]

Tasi

[11] Patent Number: 5,531,592

[45] Date of Patent: Jul. 2, 1996

[54] HANDY GAS TORCH

[76] Inventor: Chin-Lin Tasi, 3F, No. 94, Sec. 4, Chung Hsin Rd., San Chung City, Taipei Hsien, Taiwan

[21] Appl. No.: 203,334

[22] Filed: Feb. 28, 1994

[51] Int. Cl.[6] ..... F23Q 7/12

[52] U.S. Cl. ..... 431/255; 431/266; 431/344; 431/345; 431/256

[58] Field of Search ..... 431/255, 345, 431/344, 266, 258, 256

[56] References Cited

U.S. PATENT DOCUMENTS

| | | | |
|---|---|---|---|
| 4,315,731 | 2/1982 | Moore | 431/345 X |
| 4,726,767 | 2/1988 | Nakajima | 431/255 X |
| 4,854,859 | 8/1989 | Lin | 431/344 |
| 4,952,138 | 8/1990 | Ho | 431/255 |
| 5,082,440 | 1/1992 | Yamamoto | 431/255 X |
| 5,222,889 | 1/1993 | Hsu | 431/255 |
| 5,304,060 | 4/1994 | Lin | 431/255 |

*Primary Examiner*—Larry Jones
*Attorney, Agent, or Firm*—Bucknam and Archer

[57] ABSTRACT

A handy gas torch of the type having a holder for accommodating a disposable cigarette lighter, a fuel gas control device for controlling the fuel gas nozzle of the cigarette lighter, a firing device for producing sparks, a mount detachably mounted on the holder at the top to hold the firing device and the fuel gas control device, wherein the fuel gas control device includes a torch nozzle connected to the fuel gas nozzle of the cigarette lighter by a nozzle tube and a connecting tube assembly, a slide switch, a pressure rod driven by the slide switch to press the push button of the cigarette lighter in opening the fuel gas nozzle.

5 Claims, 3 Drawing Sheets

HANDY GAS TORCH

BACKGROUND OF THE INVENTION

The present invention relates to a handy gas torch which uses a regular disposable cigarette lighter to provide a fuel gas.

The commercially available cigarette lighters are inexpensive and convenient in use. However, a regular cigarette lighter cannot be used in soldering or burning things continuously for a length of time because because the casing of the cigarette lighter will become hot within a short length of time causing the user unable to hold the cigarette lighter in the operative position. There are handy gas torches which use a disposable cigarette lighter as a fuel gas source so that fuel gas can be conveniently supplied. However, these handy gas torches are commonly expensive and complicated in structure, and furthermore they are not safe in use.

SUMMARY OF THE INVENTION

It is one object of the present invention to provide a handy gas torch which uses a commercially available, disposable cigarette lighter as the fuel gas source for supplying a fuel gas for burning. It is another object of the present invention is to provide a safety device for a handy gas torch which prohibits the firing device thereof from being triggered erroneously. It is still another object of the present invention to provide a handy gas torch which is inexpensive to manufacture. According to the preferred embodiment of the present invention, the handy gas torch comprises a holder for accommodating a disposable cigarette lighter, a fuel gas control device for controlling the fuel gas nozzle of the cigarette lighter, a firing device for producing sparks, a mount detachably mounted on the holder at the top to hold the firing device and the fuel gas control device, wherein the fuel gas control device comprises a torch nozzle connected to the fuel gas nozzle of the cigarette lighter by a nozzle tube and a connecting tube assembly, a slide switch, and a pressure rod driven by the slide switch to press the push button of the cigarette lighter in opening the fuel gas nozzle. When the slide switch is off, the depressible firing button of the firing device is stopped from being depressed.

DETAILED DESCRIPTION OF THE PREFERRED EMBODIMENT

Figure 1:
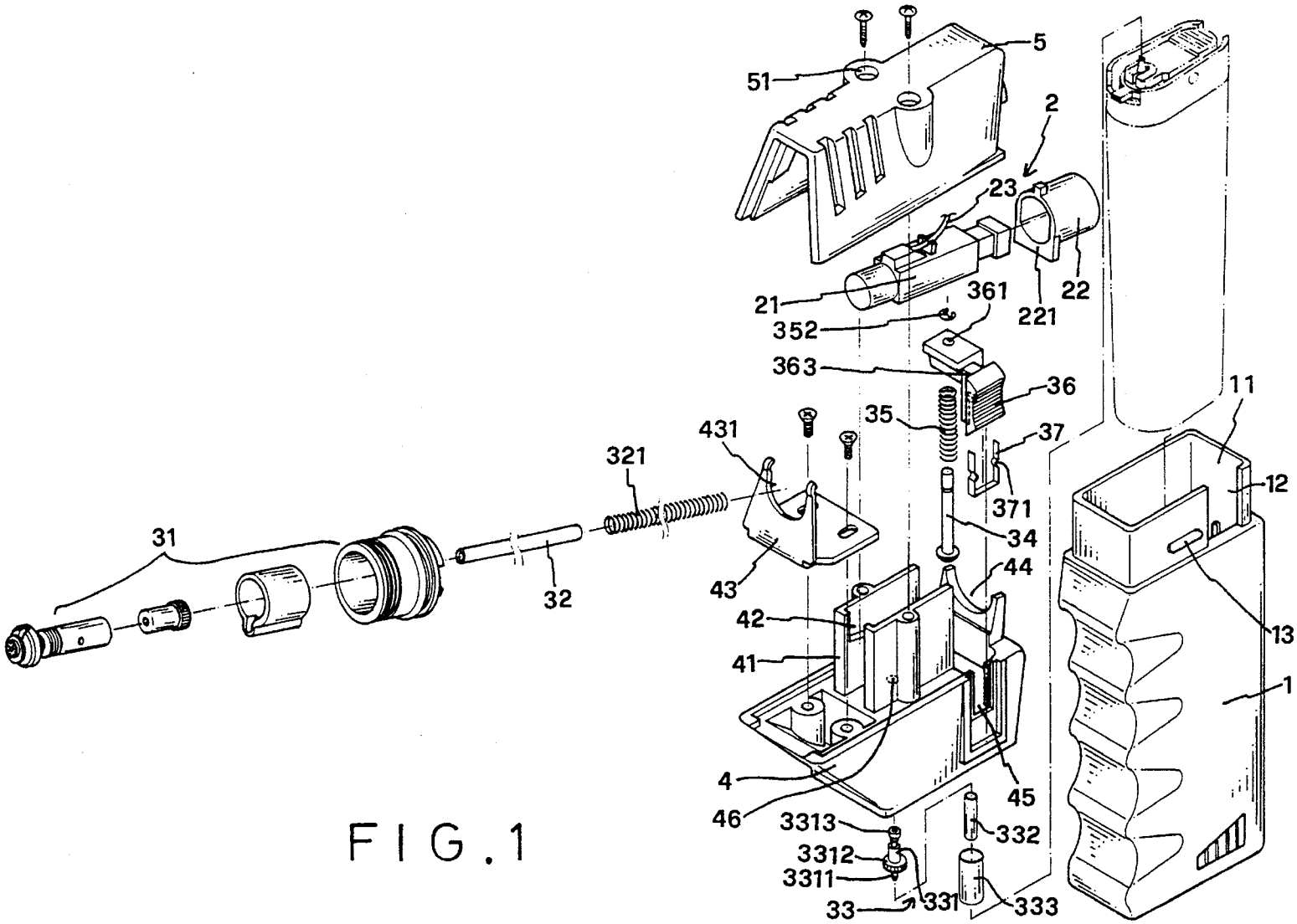
FIG. 1 is an exploded view of a gas torch according to the preferred embodiment of the present invention.
Figure 2:
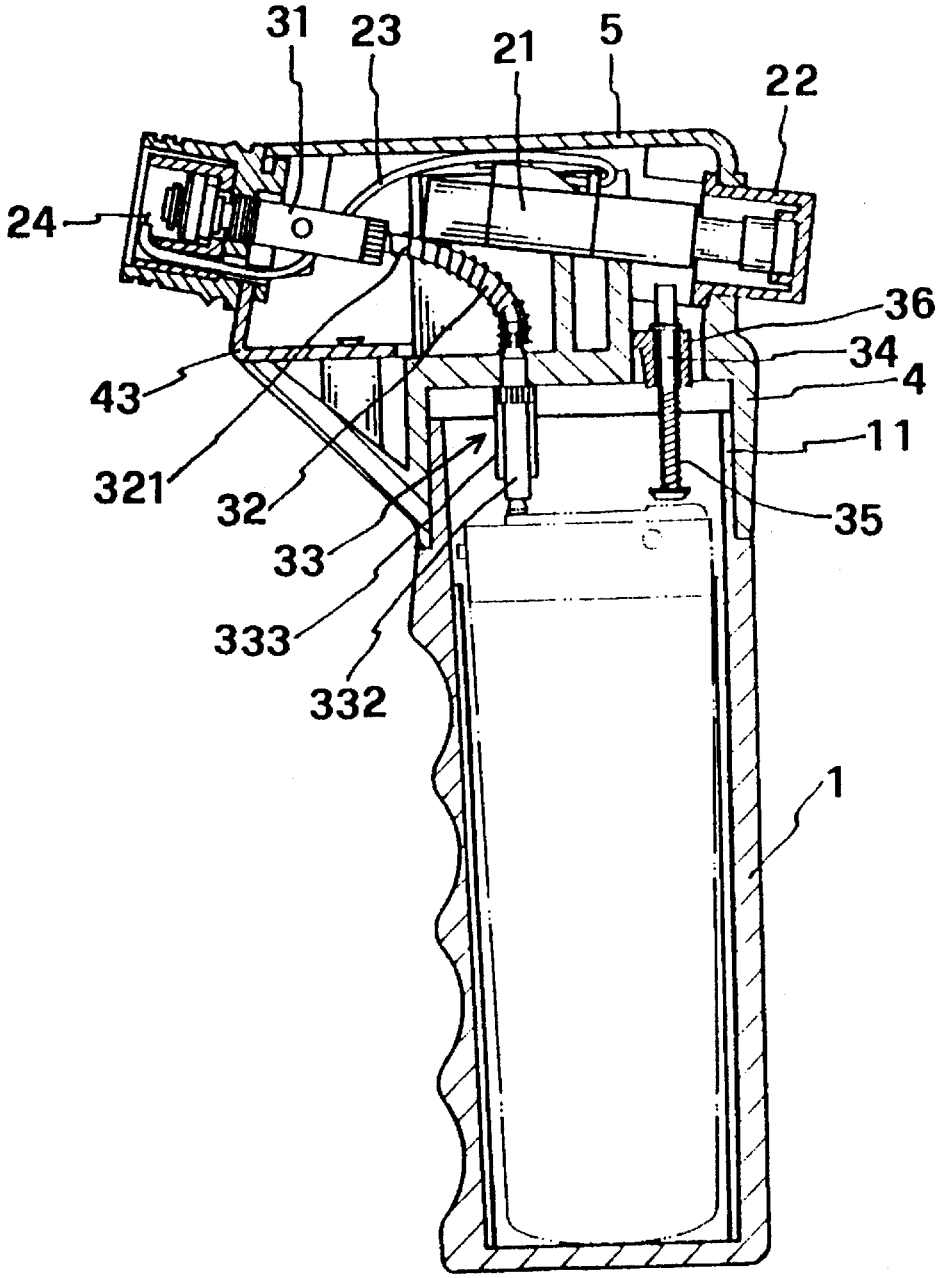
FIG. 2 is a longitudinal view in section of the gas torch shown in FIG. 1.
Figure 3:
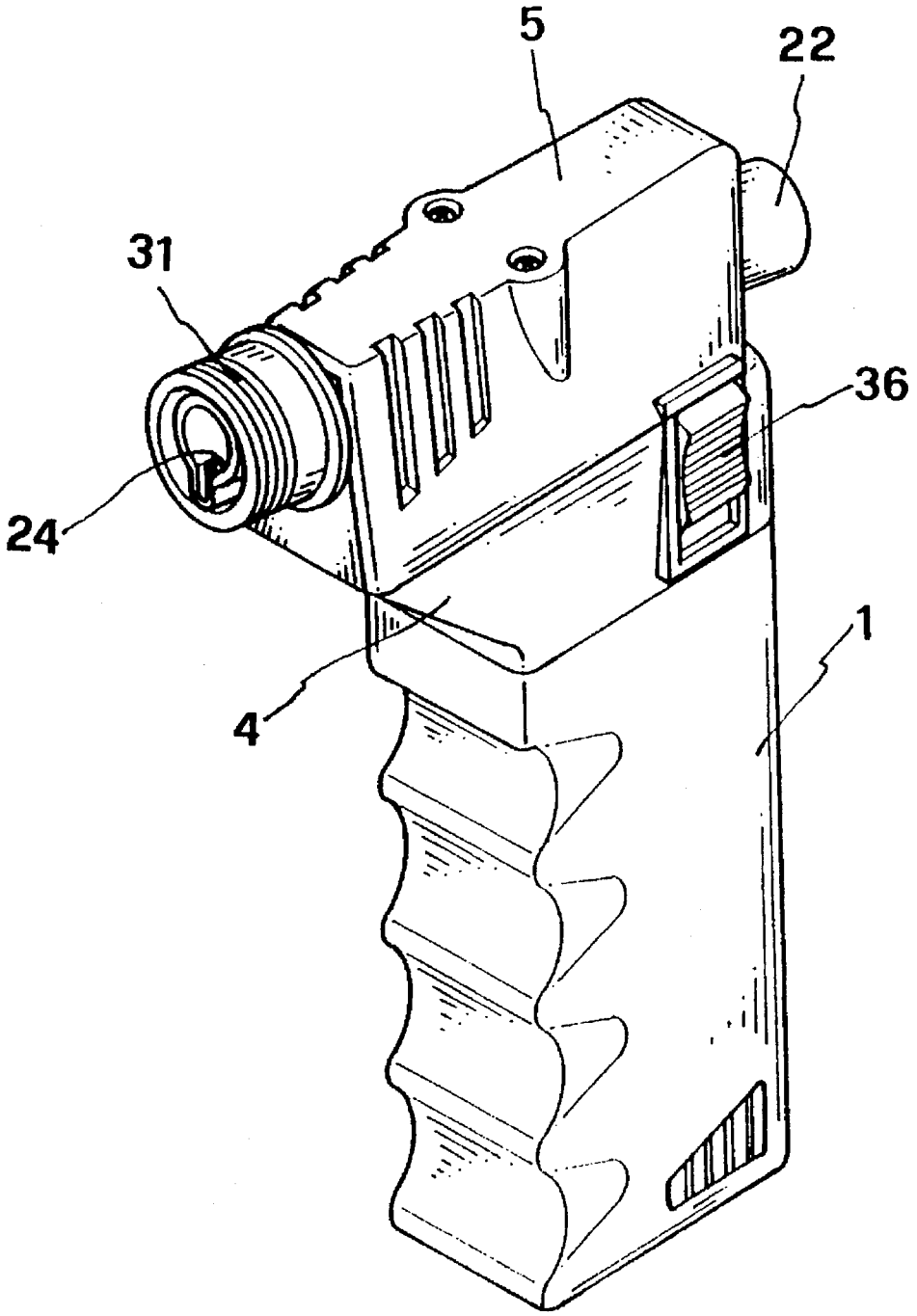
FIG. 3 is an elevational view of the gas torch shown in FIG. 1.

Referring to FIGS. 1, 2, and 3, a gas torch in accordance with the present invention is generally comprised of a holder 1, a firing device 2, a fuel gas control device 3, a mount 4, and a top cover 5.

The holder 1 is a top-open container for accommodating a commercially available disposable cigarette lighter (see the imagination line), having a top flange 11 around the border of the top opening thereof, an opening 12 on the top flange 11 at one side, and two elongated tenons 13 horizontally raised from two opposite sides of the top flange 11 on the outside.

The firing device 2 comprises a spark emitting device 21 supported on the mount 4, and a depressible firing button 22 controlled to trigger the spark emitting device 21. The spark emitting device 21 comprises a sparking circuit 23 controlled by the depressible firing button 22, and a spark emitting tip 24 connected to the sparking circuit 23 and spaced near the torch nozzle 31 of the fuel gas control device 3. By pressing the depressible firing button 22, the spark emitting tip 24 is triggered to emit sparks causing the ejection of fuel gas from the torch nozzle 21 burned.

The fuel gas control device 3 comprises a torch nozzle 31, a flexible nozzle tube 32 having one end connected to the torch nozzle 31 and an opposite end connected to the fuel gas nozzle of the cigarette lighter by a connecting tube assembly 33, a coil spring 321 mounted around the nozzle tube 32 and stopped between the torch nozzle 31 and the connecting tube 33, a slide switch 36 projected over the opening 12 of the top flange 11 of the holder 1 and having a neck 363 in the middle moved to slide in a vertical track 45 on the mount 4, an upright pressure rod 34 having a bottom end stopped at the push button of the cigarette lighter (which controls the passage of the fuel gas nozzle of the cigarette lighter) and a top end inserted through a hole 361 on the slide switch 36 and retained in place by a clamp 352, a coil spring 35 mounted around the upright pressure rod 34 and retained between the push button of the cigarette lighter and the slide switch 36, and a retainer spring 37 fastened to the mount 4 and having two opposed projections 371 for holding the slide switch 36 between the operative position (ON) and the non-operative (OFF) position. The connecting tube assembly 33 is comprised of a connector 331, an inner connecting tube 332, and an outer connecting tube 333. The connector 331 has a top output end 3313 inserted through a through hole 46 on the mount 4 from the bottom and connected to the nozzle tube 32, a bottom input end 3311 connected to the inner connecting tube 332 at the top, and a collar 3312 fitted into and affixed to the outer connecting tube 333 at the top. The inner connecting tube 332 has an opposite end connected to the fuel gas nozzle of the cigarette lighter. Therefore, when the slide switch 36 is moved down to the operative position, the push button of the cigarette lighter is depressed causing the fuel gas nozzle of the cigarette lighter opened for letting a the fuel gas be driven out of the fuel gas container of the cigarette lighter and sent out of the torch nozzle 31 through the connecting tube assembly 33 and the nozzle tube 32.

The mount 4 comprises a mounting hole (not shown) at the bottom, which receives the top flange 11 of the holder 1, a vertical track 45 at one side, which receives the slide switch 36, a through hole 46 in the middle, through which the top output end 3313 of the connector 331 passes, two upright walls 41 spaced at the two opposite sides at top and defining a chamber 42 to hold the firing device 2, a torch nozzle support 43 disposed at one end at the top and having a curved portion 431 to accommodate the torch nozzle 31, and a firing button support 44 disposed at an opposite end at the top to accommodate the depressible firing button 22. When the top flange 11 of the holder 1 is inserted into the mounting hole of the mount 4, the tenons 13 on the top flange 11 are engaged into a respective mortise (not shown) inside the mount 4, and therefore the mount 4 is firmly retained to the holder 1.

The top cover 5 has two mounting holes 51 respectively fastened to the two upright walls 41 of the mount 4 at the top. When assembled, the top cover 5 covers over the firing device 2 and the fuel gas control device 3.

Referring to FIG. 2 again, when the slide switch 36 is moved down to the operative position, the push button of the cigarette lighter is depressed causing the fuel gas nozzle of the cigarette lighter opened for letting a the fuel gas be driven out of the fuel gas container of the cigarette lighter and sent out of the torch nozzle 31 through the connecting tube assembly 33 and the nozzle tube 32, and at the same time the depressible firing button 22 is pressed causing the spark emitting tip 24 to produce sparks in burning the fuel gas being ejected from the torch nozzle 31. When the slide switch 36 is moved up to the non-operative position, the fuel gas is stopped. If the depressible firing button 22 is depressed when the slide switch 36 is disposed at the non-operative position, the bottom flange 221 on the depressible firing button 22 will be stopped by the top end of the pressure rod 34, and therefore the spark emitting device 21 does not work. This safety arrangement makes the gas torch safe in use.

Because the slide switch 36 is switched on only when it is moved to the lower limit (unlike the regular switches which work only when they are moved to the upper limit), young children cannot recognize its operation easily, and therefore the handy gas torch will not be triggered easily when played by children.

When the fuel gas is used up, the mount 4 is removed from the top flange 11 of the holder 1 by pressure, and then the disposable cigarette lighter is replaced with a new one. Because the firing device 2 and the fuel gas control device 3 are mounted on the mount 4, when the mount 4 is removed from the holder 1 for replacing the disposable cigarette lighter, the depressible firing button 22 and the slide switch 36 will not be triggered.

While only one embodiment of the present invention has been shown and described, it will be understood that various modifications and changes could be made without departing from the spirit and scope of the invention.

What is claimed is:

1. A handy gas torch comprising: a holder for accommodating a fuel gas container of the type having a fuel gas nozzle and a push button for controlling the passage of the fuel gas nozzle, said holder having a top flange around a top opening thereof, said top flange having a side opening at one side and elongated tenons horizontally raised from two opposite sides thereof on the outside; a firing device, said firing device comprising a spark emitting device, and a depressible firing button controlled to trigger said spark emitting device causing it to produce sparks through a spark emitting tip thereof; a fuel gas control device, said fuel gas control device comprising a torch nozzle disposed near said spark emitting tip, a connecting tube assembly connected to the fuel gas nozzle of the fuel gas container being received in said holder, and a nozzle tube connected between said torch nozzle and said connecting tube assembly; the improvement comprising:

a mount mounted on said top flange of said holder and retained in place by said tenons, said mount having a vertical track at one side in parallel with the side opening on said top flange of said holder, a through hole in the middle, through which said connecting tube assembly passes, two upright walls bilaterally spaced at the top and defining a chamber, which receives said said firing device, and a torch nozzle support at one end, which supports the torch nozzle of said fuel gas control device;

a slide switch having one end disposed out of the side opening on the top flange of said holder and being moved to slide in the vertical track on said mount between the operative position at an upper limit and the non-operative position at a lower limit;

a pressure rod having a top end inserted through a hole on said slide switch and retained in place by a clamp, and a headed bottom end stopped at the push button of the fuel gas container being received in said holder;

a coil spring mounted around said pressure rod and retained between said slide switch and the headed bottom end of said pressure rod; and wherein when said slide switch is moved to the lower limit, the push button of the fuel gas container is depressed by said pressure rod, and the fuel gas in the fuel gas container is driven out of the fuel gas nozzle and sent out of said torch nozzle for burning by sparks being produced by said firing device.

2. The handy gas torch of claim 1 wherein said fuel gas container is a disposable cigarette lighter.

3. The handy gas torch of claim 1 wherein said connecting tube assembly is comprised of a connector, an inner connecting tube, and an outer connecting tube, said connector having a top output end inserted through the through hole on said mount from the bottom and connected to said nozzle tube, a bottom input end connected to said inner connecting tube at the top, and a collar fitted into and affixed to said outer connecting tube at the top, said inner connecting tube having an opposite end connected to the fuel gas nozzle of the fuel gas container being received in said holder.

4. The handy gas torch of claim 1 wherein when said slide switch is disposed in said vertical track at the top, the top end of said pressure rod stops said depressible firing button from triggering said spark emitting device.

5. The improvement of claim 1 further comprising a retainer spring having two opposed projections retained to said slide switch at two opposite sides to alternatively hold said slide switch in said upper limit or said lower limit.

* * * * *

UNITED STATES PATENT AND TRADEMARK OFFICE

CERTIFICATE OF CORRECTION

PATENT NO. : 5,531,592
DATED : JULY 2, 1996
INVENTOR(S) : CHIN-LIN TSAI

It is certified that error appears in the above-indentified patent and that said Letters Patent is hereby corrected as shown below:

On the title page, items [19] and [76] correct the spelling of the name of the inventor to:--Chin-Lin Tsai--

Signed and Sealed this

Twenty-fourth Day of September, 1996

*Attest:*

Bruce Lehman

BRUCE LEHMAN

*Attesting Officer*

*Commissioner of Patents and Trademarks*